US008077099B1

(12) United States Patent
Wesh et al.

(10) Patent No.: US 8,077,099 B1
(45) Date of Patent: Dec. 13, 2011

(54) MULTI-BAND SYMMETRIC PHASE CENTER FOLDED MONOPOLE ANTENNA FOR GPS/PROXIMITY MUNITIONS FUSE APPLICATIONS

(75) Inventors: James B. Wesh, Cedar Rapids, IA (US); Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1188 days.

(21) Appl. No.: 11/827,329

(22) Filed: Jul. 11, 2007

Related U.S. Application Data

(63) Continuation-in-part of application No. 11/821,824, filed on Jun. 26, 2007.

(51) Int. Cl.
*H01Q 1/28* (2006.01)

(52) U.S. Cl. ..... 343/705; 343/749; 102/384; 244/3.14

(58) Field of Classification Search ..... 343/705, 343/708, 749; 102/384; 244/3.14, 3.15
See application file for complete search history.

(56) References Cited

U.S. PATENT DOCUMENTS

| | | | | |
|---|---|---|---|---|
| 6,020,854 | A * | 2/2000 | Jagnow et al. | 343/705 |
| 6,098,547 | A * | 8/2000 | West | 102/214 |
| 6,307,514 | B1 * | 10/2001 | West | 343/705 |
| 6,473,041 | B2 * | 10/2002 | Koch et al. | 343/700 MS |
| 7,819,061 | B2 * | 10/2010 | Geswender et al. | 102/206 |

* cited by examiner

*Primary Examiner* — Tan Ho

(74) *Attorney, Agent, or Firm* — Daniel M. Barbieri

(57) ABSTRACT

The present invention is a folded monopole antenna assembly. The folded monopole antenna assembly includes a dielectric substrate, the dielectric substrate being configured for receiving at least one input. The folded monopole antenna assembly further includes a folded monopole antenna. The folded monopole antenna is configured for being connected with the dielectric substrate. Further, the folded monopole antenna includes at least one reactive circuit. The folded monopole antenna is further configured for receiving a signal via a received input included in the at least one received input. The antenna assembly is configured for implementation within an artillery shell and/or a munition.

20 Claims, 5 Drawing Sheets

MULTI-BAND SYMMETRIC PHASE CENTER FOLDED MONOPOLE ANTENNA FOR GPS/PROXIMITY MUNITIONS FUSE APPLICATIONS

CROSS-REFERENCE TO RELATED APPLICATIONS

The present application is a continuation-in-part application and claims priority under 35 U.S.C. §120 to the U.S. patent application Ser. No. 11/821,824 entitled: "Munitions/Artillery Shell GPS Multi-Edge Slot Anti-Jamming Array", filed Jun. 26, 2007 (pending), which is herein incorporated by reference in its entirety.

FIELD OF THE INVENTION

The present invention relates to the field of artillery shells and more particularly to a multi-band symmetric phase center folded monopole antenna for satellite-based positioning system (ex—GPS) and proximity munitions fuse applications.

BACKGROUND OF THE INVENTION

Artillery shells typically utilize a fuse installed at the leading end of the shell. The fuse may be a mechanical or electronic device designed to control the detonation of the explosive charge (ex—payload) of the shell. A number of currently available artillery shell fuses include electronics and telemetry systems for promoting improved accuracy and detonation control. Electronic circuits disposed in the fuse remain in radio-frequency contact with a ground station after launch of the shell for coordinating the trajectory of the shell and making course corrections as necessary. Further, the artillery fuse may operate in conjunction with a satellite-based positioning system, such as the NAVSTAR global positioning systems (GPS), maintained and operated by the United States government, for accurately determining the coordinates of the shell as it travels along its trajectory and reaches the point of impact, and for correcting the trajectories of subsequently fired munitions. GPS may also be used as a positional reference to deploy retractable airfoil flaps of an artillery shell, from a previous free fall state, to more accurately control the downward descent of the artillery shell towards the target.

An artillery shell fuse having telemetry and positioning system electronics requires an antenna suitable for the application and environment to which an artillery shell is subject. A number of currently available antennas have radiation patterns which are omni-directional in orthogonal directions about the shell trajectory and thus, may be capable of being jammed from terrestrial positions. Other currently available antennas may be subject to performance degradation effects including carrier-phase roll up, phase carrier wrap, and roll-ripple due to antenna asymmetry.

Thus, it would be desirable to have an antenna system for artillery shells which addresses the problems associated with current solutions.

SUMMARY OF THE INVENTION

Accordingly an embodiment of the present invention is directed to an artillery shell, including: a payload; a guidance system including a radio receiver; and a folded monopole antenna array communicatively coupled to the radio receiver, the folded monopole antenna array including at least one folded monopole antenna assembly, the at least one folded monopole antenna assembly including at least one multi-band folded monopole antenna and a dielectric substrate, the dielectric substrate configured for receiving at least one input, the at least one multi-band folded monopole antenna including at least one reactive circuit, the at least one multi-band folded monopole antenna configured for being connected with the dielectric substrate, the at least one multi-band folded monopole antenna further configured for receiving a signal via a received input included in the at least one received input.

A further embodiment of the present invention is directed to a folded monopole antenna assembly including: a dielectric substrate, the dielectric substrate configured for receiving at least one input; and a folded monopole antenna, the folded monopole antenna configured for being connected with the dielectric substrate, the folded monopole antenna including at least one reactive circuit, the folded monopole antenna further configured for receiving a signal via a received input included in the at least one received input, wherein the antenna assembly is configured for implementation within at least one of an artillery shell and a munition.

An additional embodiment of the present invention is directed to an antenna assembly including: a first dielectric substrate; a second dielectric substrate configured for being connected with the first dielectric substrate, at least one of the first dielectric substrate and the second dielectric substrate being configured for receiving at least one input; a first folded monopole antenna, the first folded monopole antenna configured for being connected with one of the first dielectric substrate and the second dielectric substrate, the first folded monopole antenna including at least one reactive circuit, the first folded monopole antenna further configured for receiving a signal via a received input included in the at least one received input; and a second folded monopole antenna, the second folded monopole antenna configured for being connected with one of the first dielectric substrate and the second dielectric substrate, the second folded monopole antenna including at least one reactive circuit, the second folded monopole antenna further configured for receiving a signal via a received input included in the at least one received input, wherein the antenna assembly is configured for implementation within at least one of an artillery shell and a munition.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

An artillery shell fuse having telemetry and positioning system electronics requires an antenna suitable for the application and environment to which an artillery shell is subject. The antenna should be able to survive the extreme acceleration and high rotational velocities typical of gun-launched projectiles. Further, the radiation pattern of the antenna telemetry should exhibit relatively high gain in the aft direction (i.e., the direction opposite the direction of travel of the shell), while the radiation pattern for the GPS system should be minimal in the direction of travel of the shell to minimize or prevent jamming from the vicinity of the target area of the shell. Such an antenna should be of sufficiently reduced size so as not to occupy a large amount of space within the interior of the fuse, and is preferably designed for operation with L-band and S-band signals. ("L" being the letter designation for microwave signals in the frequency range from 1 to 2 GHz; "S" being the letter designation for microwave signals in the frequency range from 2 to 4 GHz).

Figure 1:
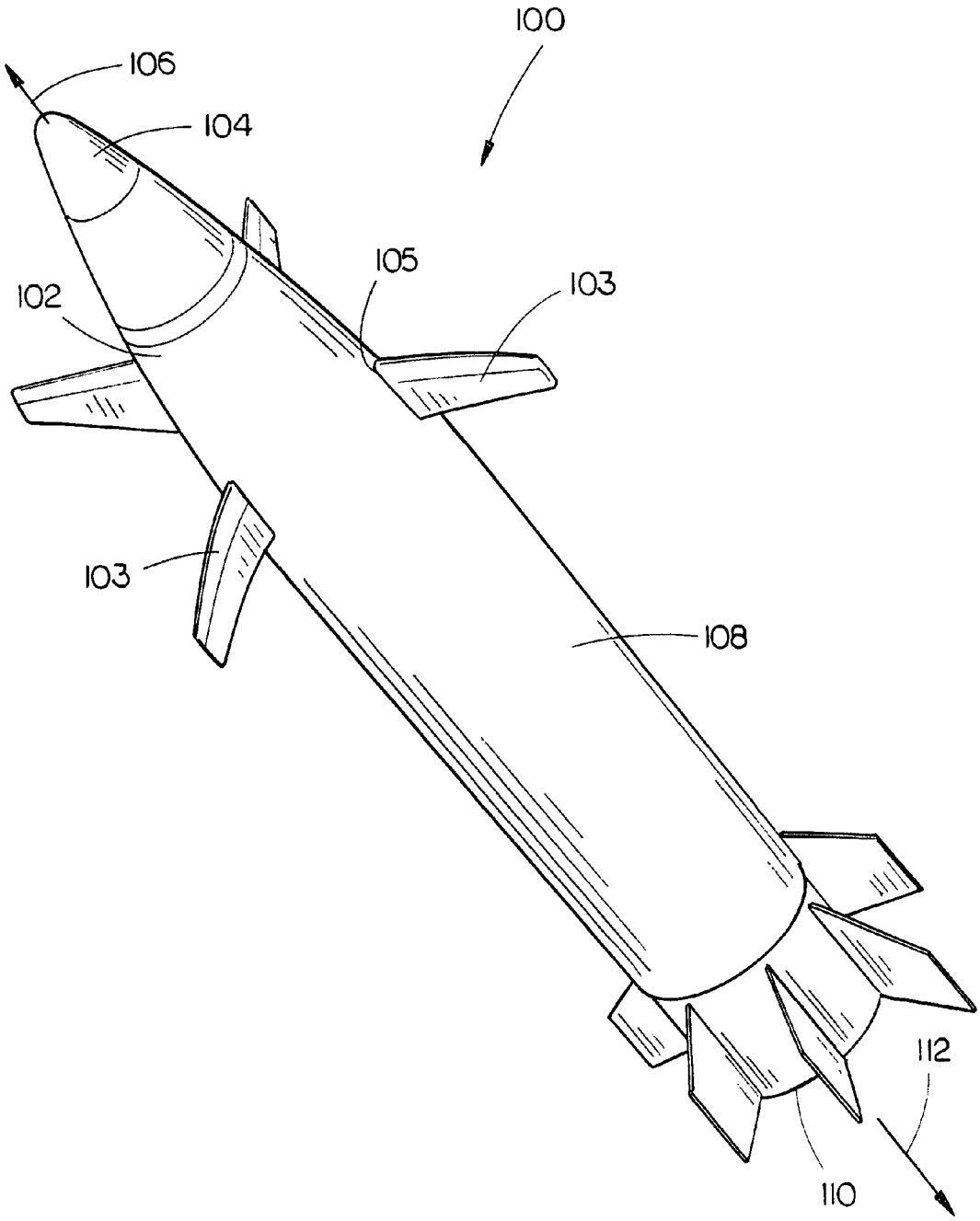
FIG. 1 is an illustration of an artillery shell in accordance with an exemplary embodiment of the present invention.

Referring now to FIG. 1, an artillery shell in accordance with the present invention is shown. The artillery shell 100 or similar munition is typically launched or fired from a cannon, mortar, or similar type of gun (not shown). A fuse 104 is disposed at the nose 102 of the artillery shell 100 and is typically physically contiguous with the body 108 of the shell. The fuse 104 may be a mechanical or electronic device utilized for detonating an explosive charge, such as the charge or payload of the artillery shell 100 or similar munition. The artillery shell 100, when launched or otherwise projected, generally travels in a forward direction 106 toward the vicinity of a target. During flight, the rear 110 of the artillery shell 100 generally points in the aft direction 112 toward the vicinity of origin of the shell (ex—toward the gun from which the shell was launched). In exemplary embodiments, during flight, retractable airfoil flaps 103 or any like selectively deployable airfoil mechanism may be deployed to change the trajectory of the shell 100. Retractable airfoil flaps 103 are shown as extending from slots 105.

Figure 3A:
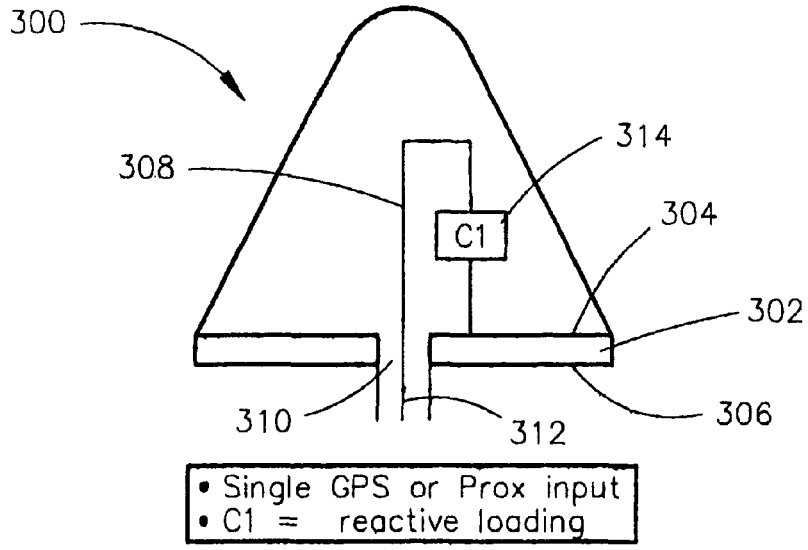
FIG. 3A is an end view of a folded monopole antenna assembly including a folded monopole antenna having a single reactive circuit in accordance with an exemplary embodiment of the present invention.

Referring generally to FIGS. 3A through 4C, exemplary embodiments of a folded monopole antenna assembly of the present invention, (which may be configured for implementation within at least one of an artillery shell 100, a munition, or a small diameter bomb platform) are shown. In a current embodiment of the present invention, as shown in FIG. 3A, a folded monopole antenna assembly 300 may include a dielectric substrate 302. For example, the dielectric substrate may be formed of Teflon® fiber-glass, or similar RF (Radio Frequency) dielectric material. Further, the dielectric substrate 302 may be a printed circuit board (PCB). In additional embodiments, the dielectric substrate 302 may be metal-plated (ex—copper-plated), such as on an upper surface (ex—upper ground) 304 of the substrate 302 and a lower surface (ex—lower ground) 306 of the substrate 302.

In exemplary embodiments, the folded monopole antenna assembly 300 may include a folded monopole antenna 308. Further, the folded monopole antenna 308 may be configured for being connected with the dielectric substrate 302. In current embodiments of the present invention, the folded monopole antenna 308 may be connected to the dielectric substrate 302 by being mounted to the dielectric substrate 302 (ex—as a surface mount configuration). Alternatively, the folded monopole antenna 308 may be connected to the dielectric substrate 302 by being embedded within the dielectric substrate 302 (ex—as an embedded passive configuration). Further, the dielectric substrate (and the antennas 308, antenna assembly 300) may be "potted" into the shape of the artillery shell/munition fuse tip 104 for promoting aerodynamics and environmental robustness of the antenna assembly 300. For example, the potted dielectric substrate 302 may be a Printed Circuit Board (PCB) having the profile of the fuse tip 104. Further, the dielectric substrate 302 may be constructed of conventional microwave printed circuit materials which may allow said substrate to be sized/constructed so as to have fuse-compatible dimensions.

In current embodiments of the present invention, the folded monopole antenna 308 may be a Global Positioning System (GPS) antenna or a Proximity Fuse (Prox) antenna. In additional embodiments, the folded monopole antenna 308 may be a multi-band antenna. For example, the folded monopole antenna 308 may be configured for supporting one or more of: an L1 GPS frequency (ex—1.575 GHz), an L2 GPS frequency (ex—1.227 GHz) or other L-band frequencies, such as L3, L5 or the like. In further embodiments, the folded monopole antenna 308 may support S-band frequencies (such as for telemetry and control) and/or C-band frequencies (such as for Height of Burst (HOB)-related direction finding).

In current embodiments of the present invention, the dielectric substrate 302 may be configured for receiving at least one input. For instance, the dielectric substrate 302 may have an aperture 310 formed therethrough for receiving an input, such as an input pin/pin probe 312. For example, the pin probe 312 may be an extension of a center conductor of a L1/L2 coaxial feed for providing a common L1/L2 input. The antenna assembly 300 may be fed via the input pin 312, such that each of the radiating elements of the antenna 308 are simultaneously excited in-phase. Further, the antenna assembly 300 may be used in conjunction with one or more feed circuits, matching circuits and/or diplexors. For instance, the input 312 of the antenna assembly 300 may be impedance-matched to a characteristic impedance of an RF feed, feed circuit, matching circuit, diplexor, or an RF transceiver assembly via an additional shielded RF microstrip layer or perpendicular (to a fuselage axis 318) stripline circuit board (ex—an RF match board), such as via numerous known techniques. For example, the RF match board may be integrated into the RF transceiver assembly. Further, such feed circuits/diplexors may provide a local ground plane for the antenna assembly 300 that ties to a fuselage ground. In additional embodiments, the folded monopole antenna 308 may be further configured for receiving a signal via the received input 312.

Figure 2:
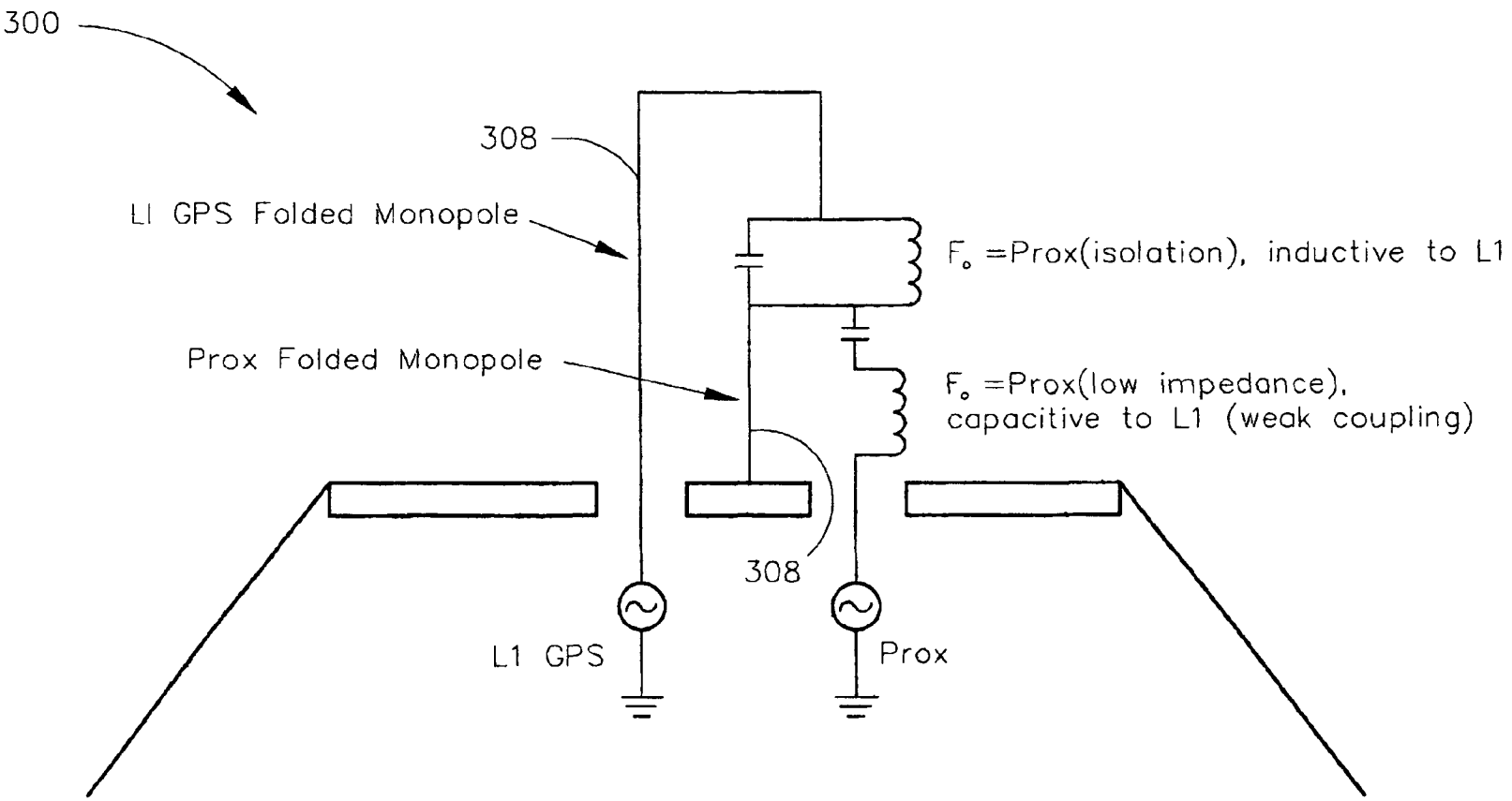
FIG. 2 is an illustration of a folded monopole antenna array implementing reactive loading via a reactive circuit in accordance with an exemplary embodiment of the present invention.

As discussed above, the folded monopole antenna 308 of the present invention may be a multi-band antenna. In an exemplary embodiment, the folded monopole antenna 308 may include at least one reactive circuit 314, the reactive circuit being configured for providing multi-band functionality to the folded monopole antenna 308. For example, various known techniques such as reactive loading, LC reactive traps/tanks, reactive tank loading, material loading, inductive tapped feed loading, capacitive top loading, transformer impedance matching, and/or the like may be implemented for providing multi-band functionality to the antenna assembly 300 of the present invention and for providing a reactively loaded antenna assembly 300. FIG. 2 illustrates an antenna assembly 300 which includes two folded monopole antennas 308 (ex—an L1 GPS folded monopole antenna and a Proximity Fuse/Prox folded monopole antenna) and further illustrates an example of the implementation of reactive tank loading via the at least one reactive circuit 314 for providing the above-referenced multi-band functionality to the folded monopole antennas 308.

Figures 4A, 4B, 4C:
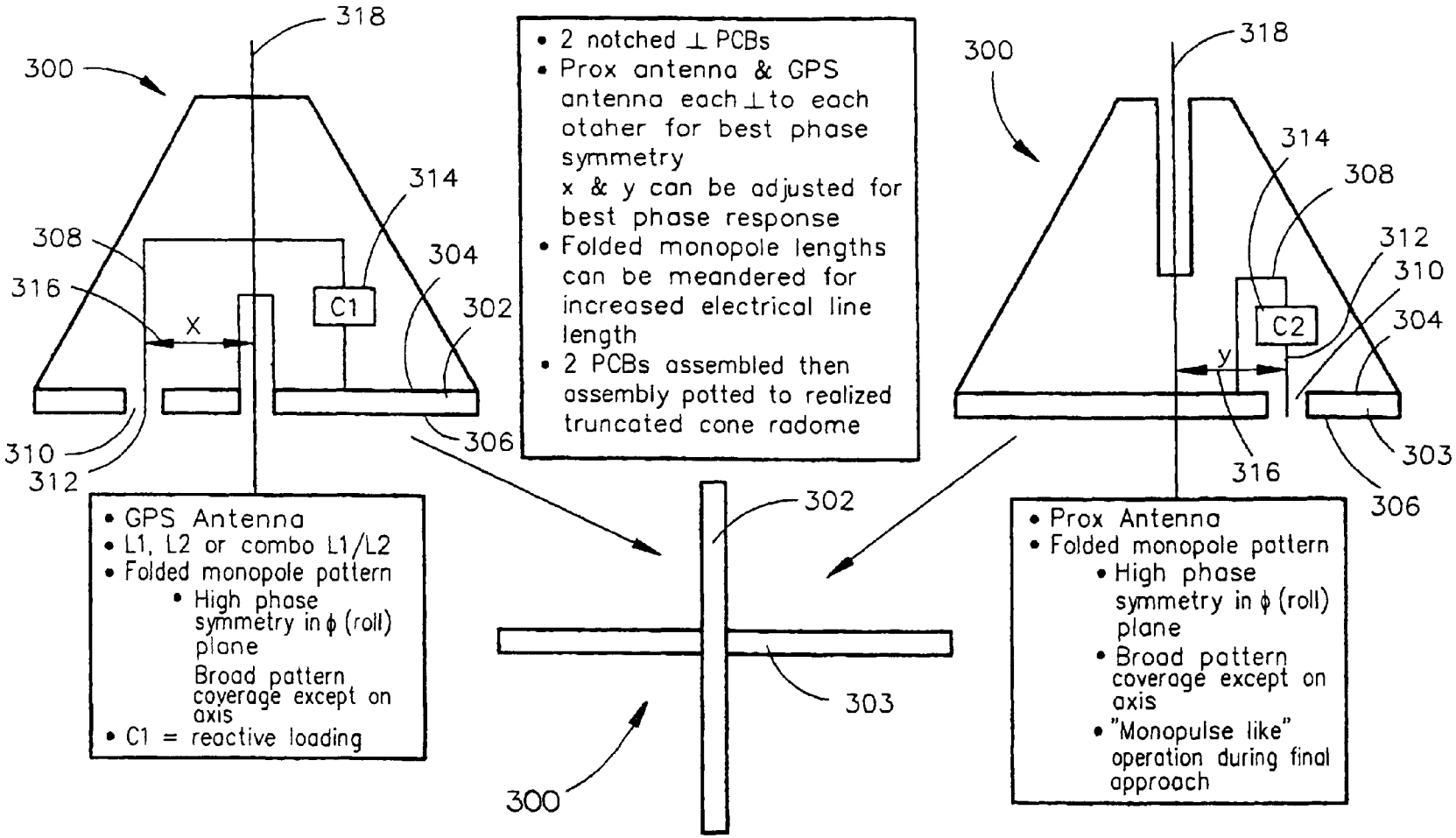
FIG. 4A is an end view of a folded monopole antenna assembly including a GPS folded monopole antenna having a single reactive circuit in accordance with an exemplary embodiment of the present invention.
FIG. 4B is an end view of a folded monopole antenna assembly including a Proximity Fuse folded monopole antenna having a single reactive circuit in accordance with an exemplary embodiment of the present invention.
FIG. 4C is a perspective view of an antenna assembly including a plurality of folded monopole antennas, each antenna connected to one of two perpendicularly connected printed circuit boards in accordance with alternative exemplary embodiments of the present invention.

As discussed above, the antenna assembly 300 may be configured for being mounted within a fuse tip 104 of at least one of an artillery shell 100 and a munition. In further embodiments, the folded monopole antenna 308 may be selectively positionable along a first axis 316 (as shown in FIGS. 4A and 4B), which is generally perpendicular to or transverse with respect to a second axis 318 (ex—a fuselage axis of the artillery shell 100) for adjusting an apparent phase center of the folded monopole antenna 308 to achieve a desired phase center response.

In exemplary embodiments, the folded monopole antenna 308 may be electrically small (ex—the largest dimension of an antenna in the array is no more than one-tenth of a wavelength), such as via implementation of wire (trace) meandering in its construction, for providing an antenna 308 with short effective height, which may promote: increased conduction current path/increased electrical line lengths for lower resonant frequency and/or improved radiation efficiency for the antenna 308 across relatively narrow bandwidths.

In further embodiments, the folded monopole antenna 308 of the antenna assembly 300 may be constructed as a bent wire structure "fixtured" with (ex—mounted to or embedded in) the dielectric substrate 302. Further, the folded monopole antenna 308 may include various lumped circuit topologies, such as multi-resonant lumped circuit topologies (ex—the reactive circuit 314). For instance, the reactive circuit 314 may include one or more circuit components, such as lumped resistors (R), inductors (L) and/or capacitors (C) which may be metallurgically bonded to the bent wire structure prior to potting of the antenna assembly 300 within the fuse tip 104 of the artillery shell 100.

The folded monopole antenna(s) 308 of the folded monopole antenna assembly 300 of the present invention may promote the provision of desired radiation patterns. For example, the folded monopole antenna(s) 308 of the folded monopole antenna assembly 300 of the present invention may allow for provision of wide (azimuthal, elevational) pattern coverage during a large percentage of a flight trajectory of an artillery shell 100/munition with an axial pattern null to final approach Anti-Jamming (A/J). As discussed above, in exemplary embodiments of the present invention, the antenna assembly 300 may provide simultaneous multi-band (ex—L1/L2) GPS functionality which may allow for exploitation of inherent linear polarization and axial phase center/axial phase symmetry for promoting GPS accuracy and minimization of phase carrier wrap/phase wrapping effect which is often a problem with spinning vehicles (ex—spinning artillery shells, munitions).

Figure 3B:
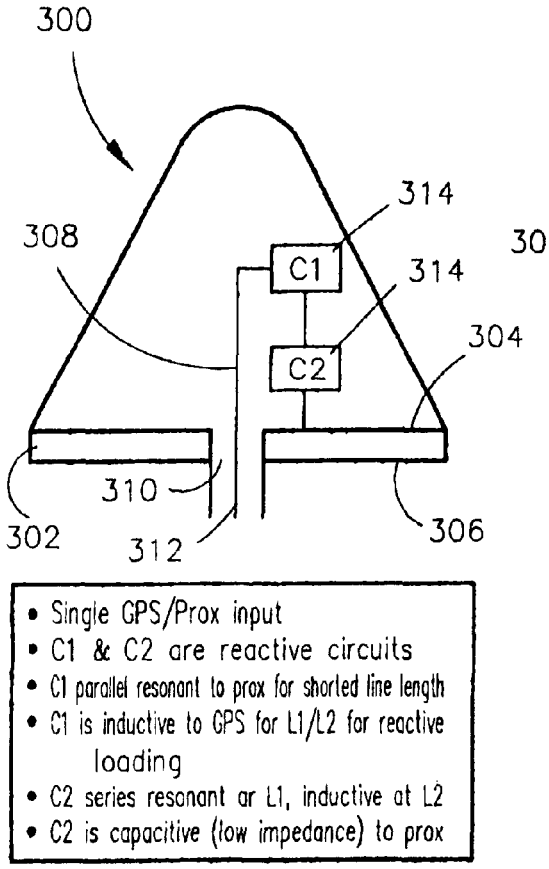
FIG. 3B is an end view of a folded monopole antenna assembly including a folded monopole antenna having a plurality of reactive circuits in accordance with a further exemplary embodiment of the present invention.
Figure 3C:
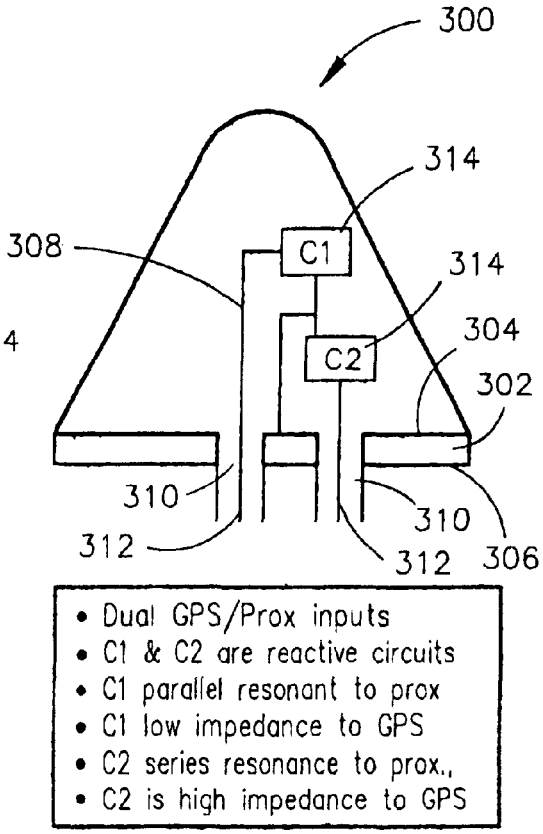
FIG. 3C is an end view of a folded monopole antenna assembly including dual inputs in accordance with an additional exemplary embodiment of the present invention.

The present invention contemplates various embodiments of the antenna assembly. FIG. 3A illustrates an antenna assembly 300 which may include a single folded monopole antenna 308 (ex—a GPS or Prox antenna) connected with a single dielectric substrate 302, the folded monopole antenna 308 being fed via a single input 312 (ex—a GPS or Prox input) and including a single reactive circuit 314. (ex—for providing reactive loading). In further embodiments, the antenna assembly 300 of the present invention may implement multiple reactive circuits 314. For example, FIG. 3B illustrates an antenna assembly 300 in which a first reactive circuit (ex—C1) and a second reactive circuit (ex—C2) are implemented with a single folded monopole antenna 308. In the embodiment illustrated in FIG. 3B, the first reactive circuit (C1) may be parallel resonant to prox for shortened line length, and may be inductive to GPS for L1/L2 for reactive loading. Further, the second reactive circuit (C2) may be series resonant at L1, may be inductive at L2, and may be capacitive (low impedance) to prox. FIG. 3C illustrates an antenna assembly 300 in which multiple (ex—dual) inputs 312 are implemented with a single folded monopole antenna 308 which includes multiple reactive circuits 314, such as a first reactive circuit (C1) and a second reactive circuit (C2). In the embodiment illustrated in FIG. 3C, the first reactive circuit (C1) may be parallel resonant to prox and may be low impedance to GPS. Further, the second reactive circuit (C2) may be series resonant to prox and may be high impedance to GPS.

As discussed above, the antenna assembly 300 may implement one or more folded monopole antennas 308, such as a GPS folded monopole antenna and/or a Prox antenna. FIG. 4A illustrates an embodiment in which the antenna assembly 300 implements a single GPS folded monopole antenna 308, which includes a single reactive circuit (C1) (ex—for reactive loading). For example, the GPS folded monopole antenna 308 may be an L1, L2 or combination L1/L2 GPS folded monopole antenna. The antenna assembly 300 shown in FIG. 4A may promote high phase symmetry in a roll (phi) plane and broad pattern coverage (except on fuselage axis 318). FIG. 4B illustrates an alternative embodiment in which the antenna assembly implements a single Prox folded monopole antenna 308, which includes a single reactive circuit (C2). The antenna assembly 300 shown in FIG. 4B may promote high phase symmetry in a roll (phi) plane and broad pattern coverage (except on fuselage axis 318). Further, the antenna assembly shown in FIG. 4B may provide "monopulse-like" operation during final approach of the artillery shell 100.

FIG. 4C illustrates an alternative embodiment of the antenna assembly 300 of the present invention. In FIG. 4C, the antenna assembly 300 includes a first dielectric substrate 302. The antenna assembly 300 further includes a second dielectric substrate 303 configured for being connected with the first dielectric substrate 302. For example, the dielectric substrates (302, 303) may be Printed Circuit Boards (PCBs) which may generally have a same profile as the fuse tip of the artillery shell 100. In the exemplary embodiment, each dielectric substrate (302, 303) may be configured for receiving one or more inputs 312. The antenna assembly 300 may further include first and second folded monopole antennas 308. The first folded monopole antenna 308 may be configured for being connected with one of the first dielectric substrate 302 and the second dielectric substrate 303. For example, the first and second folded monopole antennas 308 may each be connected with the same dielectric substrate (ex—both connected with 302, while substrate 303 acts to provide fixturing/rigidity for the antenna assembly 300) or different dielectric substrates (ex—first folded monopole antenna connected with first dielectric substrate 302, second folded monopole antenna connected with second dielectric substrate 303). For instance, each folded monopole antenna 308 may be configured for receiving a signal via the input(s) 312 received by the dielectric substrate (302 or 303) with which that antenna 308 is connected. Each folded monopole antenna 308 may include one or more reactive circuits 314. In alternative embodiments, multiple antennas 308 may be included on one or both of the substrates (302, 303).

In the embodiment shown in FIG. 4C, the first dielectric substrate 302 may form a slot 305 and the second dielectric substrate 303 may form a slot 307, said substrates (302, 303) configured for being connected to each other/keyed to one another via the indexing slots (305, 307). For instance, when connected, the dielectric substrates (302, 303) may be connected/assembled perpendicularly with respect to one another (as shown in FIG. 4C) for promoting improved phase symmetry. For instance, once assembled, the perpendicular antenna assembly 300 of FIG. 4C may be potted such that it configures to the profile of the fuse tip 104, such as a truncated cone radome of an artillery shell 100.

In embodiments in which multiple folded monopole antennas 308 (ex—a GPS antenna and a Prox antenna) are implemented, said antennas 308 may be independent and orthogonal to one another within the fuse tip 104 of the artillery shell 100.

In exemplary embodiments, one or more antenna assemblies (i.e. folded monopole antenna assemblies) 300, each as described above, may be implemented in the present invention to form an antenna array 200. Further, the antenna array 200 may include two or more multi-element antenna assemblies 300 (or the antenna assembly 300 may include two or more multi-element antennas 308) for promoting maximized anti-jamming (NJ) performance and for providing an anti-jamming array 200 (or assembly 300) with maximized antenna separation on the fuse 104. For example, the antenna assemblies 300 may be conformal antenna assemblies (sized so as not to perturb general shape of the projectile) which may be implemented within an artillery shell 100 (such as being embedded in a radome 302 of the artillery shell 100 as shown in FIG. 3) and may be configured for receiving signals (such as GPS signals) via electronics (ex—DIGNU/IGS—Deeply Integrated Guidance Navigation Unit/Inertial Guidance System) contained within the artillery shell 100 for promoting course or trajectory correction functionality for the artillery shell (as will be described further below). In embodiments implementing multiple antenna assemblies 300, each antenna assembly 300 may implement multiple ground layers, such as RF ground layers and may further implement multiple dielectric layers. Further, as described previously, multiple frequencies may be supported by each antenna assembly 300. For instance, each antenna assembly 300 may support a first frequency (ex—L1) and a second frequency (ex—L2).

In additional embodiments, the antenna assembly 300 may be frequency scaled for providing a simplified direction guidance system for guiding an emitter signal into a null of the antenna's radiation pattern for a power detection based steering system, which may promote neutralization of jammer signal emitters in some CONOPS (Concept of Operations) scenarios.

In exemplary embodiments, implementation of the folded monopole antennas 308 of the present invention may promote production of a rotationally symmetric radiation pattern (ex—promote provision of rotationally symmetric phase center properties). Additionally, the folded monopole antennas 308 of the present invention may promote production of a radiation pattern which has a gain of 0 dB or better over much of the pattern. Also, the folded monopole antennas 308 of the present invention may provide hemispherical coverage and may promote maximized GPS satellite reception and GDOP (Geometric Dilution of Precision).

In further alternative embodiments of the present invention, array flexibility may be increased by implementing various combinations of other radiating elements in conjunction with the antenna assembl(ies) 300/antenna array 200 of the present invention in munitions/artillery shells/GPS munitions shells 100, such as the sectoral circular slot antenna array described in U.S. Pat. No. 6,307,514 entitled: "Method and System for Guiding an Artillery Shell", and/or the circumferential slot antenna described in U.S. Pat. No. 6,098,547 entitled: "Artillery Fuse Circumferential Slot Antenna for Positioning and Telemetry" both of which are hereby incorporated by reference in their entireties. Further, the antenna assembly 300 of the present invention may be readily compatible/implementable with a Radial Transmission Line ("hockey puck") antenna(s), such as those described in the U.S. patent application entitled: "Munitions/Artillery Shell GPS Multi-Edge Slot Anti-Jamming Array", filed Jun. 26, 2007, having Express Mail Mailing Label Number EM 005 738 190 US (pending) which is incorporated by reference in its entirety.

Figure 5:
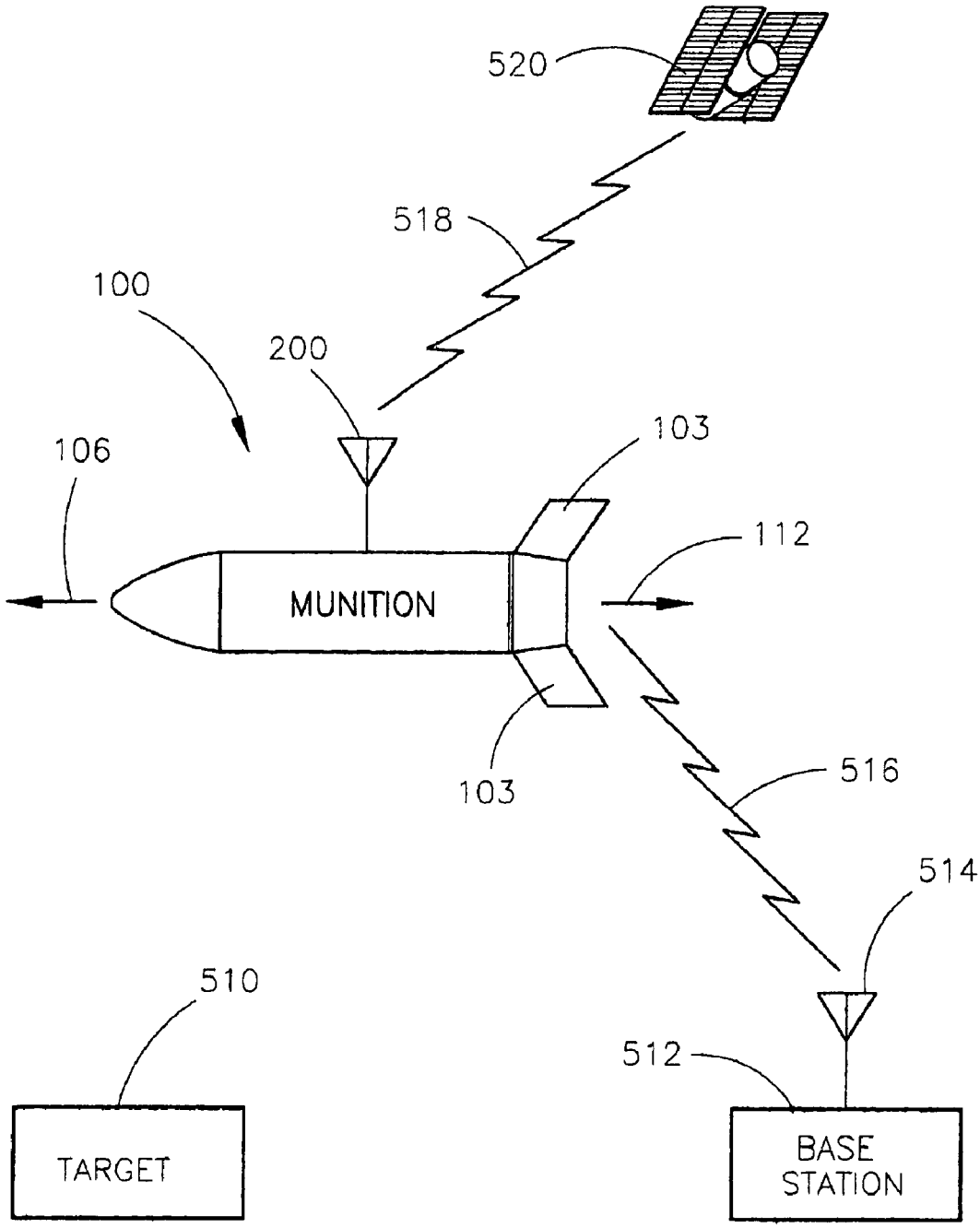
FIG. 5 is a communications schematic for an artillery shell/munition implementing a folded monopole antenna array of the present invention in accordance with an exemplary embodiment of the present invention.

Referring now to FIG. 5, there is shown a system of the present invention, which includes an artillery shell 100, which has been launched in a typical manner. The artillery shell 100 is moving in a forward direction 106 along a trajectory generally directed toward a target 510. The artillery shell has come from/originated from a rearward/aft direction 112 along the trajectory. In exemplary embodiments, it may be desirable to change the trajectory of the artillery shell 100, while said shell is in flight, in order to assure proper interaction with the target 510. In current embodiments of the present invention, the artillery shell 100 includes an on-board GPS receiver which continuously monitors the shell's position via a space directed signal 518 from satellite 520. The antenna array 200 may receive these GPS or other signals and may make course corrections either locally or via telemetry. Further, the antenna array may make other communications with a base station 512, through a terrestrial RF signal 516, and base station antenna 514. In additional embodiments, commands may be sent to the artillery shell 100 to deploy its retractable airfoil flaps 103, so as to change the aerodynamics, speed, and therefore, trajectory of the artillery shell 100. Still further, other signals, such as detonation commands for airborne detonation (of an explosive charge/payload of the shell), could be sent to the artillery shell 100 as well.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An artillery shell, comprising:

a payload;

a guidance system including a radio receiver; and a folded monopole antenna array communicatively coupled to the radio receiver, the folded monopole antenna array including at least one folded monopole antenna assembly, the at least one folded monopole antenna assembly including at least one multi-band folded monopole antenna and a dielectric substrate, the dielectric substrate configured for receiving at least one input, the at least one multi-band folded monopole antenna including at least one reactive circuit, the at least one multi-band folded monopole antenna configured for being connected with the dielectric substrate, the at least one multi-band folded monopole antenna further configured for receiving a signal via a received input included in the at least one received input.

2. An artillery shell as claimed in claim 1, wherein the folded monopole antenna array is configured for being mounted in a fuse tip of the artillery shell.

3. An artillery shell as claimed in claim 1, wherein the at least one multi-band folded monopole antenna of the antenna array is at least one of a Global Positioning System (GPS) antenna and a Proximity Fuse antenna.

4. An artillery shell as claimed in claim 1, wherein the at least one multi-band folded monopole antenna of the antenna array is configured for supporting at least one of: L-band frequencies, S-band frequencies and C-band frequencies.

5. A folded monopole antenna assembly, comprising:

a dielectric substrate, the dielectric substrate configured for receiving at least one input; and a folded monopole antenna, the folded monopole antenna configured for being connected with the dielectric substrate, the folded monopole antenna including at least one reactive circuit, the folded monopole antenna further configured for receiving a signal via a received input included in the at least one received input, wherein the antenna assembly is configured for implementation within at least one of an artillery shell and a munition.

6. A folded monopole antenna assembly as claimed in claim 5, wherein the folded monopole antenna is configured for being mounted in a fuse tip of at least one of the artillery shell and the munition, the folded monopole antenna being selectively positionable along a first axis for adjusting an apparent phase center of the folded monopole antenna, the first axis being transverse with respect to a second axis, the second axis being a fuselage axis of at least one of the artillery shell and the munition.

7. An artillery shell as claimed in claim 5, wherein the folded monopole antenna is at least one of a Global Positioning System (GPS) antenna and a Proximity Fuse antenna.

8. An artillery shell as claimed in claim 5, wherein the folded monopole antenna is configured for supporting at least one of: L-band frequencies, S-band frequencies and C-band frequencies.

9. An antenna assembly, comprising:

a first dielectric substrate;

a second dielectric substrate configured for being connected with the first dielectric substrate, at least one of the first dielectric substrate and the second dielectric substrate being configured for receiving at least one input;

a first folded monopole antenna, the first folded monopole antenna configured for being connected with one of the first dielectric substrate and the second dielectric substrate, the first folded monopole antenna including at least one reactive circuit, the first folded monopole antenna further configured for receiving a signal via a received input included in the at least one received input; and a second folded monopole antenna, the second folded monopole antenna configured for being connected with one of the first dielectric substrate and the second dielectric substrate, the second folded monopole antenna including at least one reactive circuit, the second folded monopole antenna further configured for receiving a signal via a received input included in the at least one received input, wherein the antenna assembly is configured for implementation within at least one of an artillery shell and a munition.

10. An antenna assembly as claimed in claim 9, wherein the first dielectric substrate forms a first slot and the second dielectric substrate forms a second slot, the first dielectric substrate and the second dielectric substrate configured for being connected via the first slot and the second slot such that the first dielectric substrate is perpendicularly oriented relative to the second dielectric substrate.

11. An antenna assembly as claimed in claim 9, wherein at least one of the first folded monopole antenna and the second folded monopole antenna are connected with one of the first dielectric substrate and the second dielectric substrate as embedded passives.

12. An antenna assembly as claimed in claim 9, wherein at least one of the first folded monopole antenna and the second folded monopole antenna are mountably connected to one of the first dielectric substrate and the second dielectric substrate.

13. An antenna assembly as claimed in claim 10, wherein the first dielectric substrate and the second dielectric substrate are printed circuit boards.

14. An antenna assembly as claimed in claim 9, wherein the first folded monopole antenna and the second folded monopole antenna are configured for being mounted in a fuse tip of at least one of an artillery shell and a munition.

15. An antenna assembly as claimed in claim 9, wherein at least one of the first folded monopole antenna and the second folded monopole antenna is a Global Positioning System (GPS) antenna.

16. An antenna assembly as claimed in claim 9, wherein at least one of the first folded monopole antenna and the second folded monopole antenna is a Proximity Fuse antenna.

17. An antenna assembly as claimed in claim 9, wherein the first folded monopole antenna and the second folded monopole antenna are multi-band antennas.

18. An antenna assembly as claimed in claim 9, wherein at least one of the first folded monopole antenna and the second folded monopole antenna include a wire meander.

19. An antenna assembly as claimed in claim 9, wherein the first folded monopole antenna and the second folded monopole antenna are configured for supporting at least one of: L-band frequencies, S-band frequencies and C-band frequencies.

20. An antenna assembly as claimed in claim 9, wherein the antenna assembly further includes at least one of: a feed circuit, a diplexor, and a matching circuit.

* * * * *